US012800239B2

(12) United States Patent
Tsutsui et al.

(10) Patent No.: US 12,800,239 B2
(45) Date of Patent: Nov. 17, 2026

(54) METHOD FOR MANUFACTURING FIN

(71) Applicant: DAIKIN INDUSTRIES, LTD., Osaka (JP)

(72) Inventors: Masahiro Tsutsui, Osaka (JP); Yoshihiro Tsutsumi, Osaka (JP); Motofumi Shimizu, Osaka (JP); Takayuki Takahashi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/890,205

(22) Filed: Sep. 19, 2024

(65) Prior Publication Data

US 2025/0012517 A1 Jan. 9, 2025

Related U.S. Application Data

(63) Continuation of application No. PCT/JP2023/002278, filed on Jan. 25, 2023.

(30) Foreign Application Priority Data

Mar. 31, 2022 (JP) ..... 2022-060674

(51) Int. Cl.
*B23P 15/26* (2006.01)
*F28F 3/02* (2006.01)

(52) U.S. Cl.
CPC ..... *F28F 3/027* (2013.01); *F28F 2215/08* (2013.01); *F28F 2255/08* (2013.01)

(58) Field of Classification Search
CPC .... F28F 3/027; F28F 2215/08; F28F 2255/08; F28F 1/325; B21D 19/08; B21D 22/02; B21D 22/20; B21D 28/10; B21D 28/26; B21D 31/06; B21D 53/022; B21D 28/265; B21D 31/005; B21D 1/0471; B21D 53/025; F28D 1/05366; F28D 1/02; F28D 1/32
See application file for complete search history.

(56) References Cited

U.S. PATENT DOCUMENTS

| | | | | |
|---|---|---|---|---|
| 5,600,992 | A | 2/1997 | Kanazawa et al. | |
| 2020/0166278 | A1 | 5/2020 | Satou et al. | |
| 2021/0262740 | A1 * | 8/2021 | Matsumoto ..... | F28D 1/0471 |

FOREIGN PATENT DOCUMENTS

| | | | |
|---|---|---|---|
| CN | 104482791 A | * | 4/2015 |
| CN | 106288911 B | | 8/2018 |
| CN | 111059953 A | | 4/2020 |

(Continued)

OTHER PUBLICATIONS

English translation of CN-104482791-A (Year: 2015).*

(Continued)

*Primary Examiner* — Jun S Yoo
(74) *Attorney, Agent, or Firm* — Spencer Fane LLP

(57) ABSTRACT

A method for manufacturing a fin for a heat exchanger includes a waffle forming step of forming a waffle portion and a plate-shaped portion around the waffle portion in a plate-shaped fin material, a cutting step of forming a continuous portion continuous with the plate-shaped portion and a fin slit configured to receive a flat tube in a side of the plate-shaped portion of the plate-shaped fin material, and a drawing step of forming a drawn portion protruding with respect to the continuous portion in the continuous portion.

6 Claims, 8 Drawing Sheets

(56) References Cited

FOREIGN PATENT DOCUMENTS

| | | | | | |
|---|---|---|---|---|---|
| JP | 57-202927 | A | | 12/1982 | |
| JP | 59141330 | A | * | 8/1984 | |
| JP | 2695126 | B2 | | 12/1997 | |
| JP | 2012-154491 | A | | 8/2012 | |
| JP | 5523495 | B2 | | 6/2014 | |
| JP | 2019-15410 | A | | 1/2019 | |
| WO | WO-2015029145 | A1 | * | 3/2015 | ..... B21D 53/025 |
| WO | 2015/058452 | A1 | | 4/2015 | |

OTHER PUBLICATIONS

English translation of JP-59141330-A (Year: 1984).*
English translation of WO-2015029145-A1 (Year: 2015).*
European Search Report of corresponding EP Application No. 23 77 8788.2 dated Apr. 7, 2025.
International Preliminary Report of corresponding PCT Application No. PCT/JP2023/002278 dated Oct. 10, 2024.
International Search Report of corresponding PCT Application No. PCT/JP2023/002278 dated Apr. 11, 2023.

* cited by examiner

METHOD FOR MANUFACTURING FIN

CROSS-REFERENCE TO RELATED APPLICATIONS

This is a continuation of International Application No. PCT/JP2023/002278 filed on Jan. 25, 2023, which claims priority to Japanese Patent Application No. 2022-060674, filed on Mar. 31, 2022. The entire disclosures of these applications are incorporated by reference herein.

BACKGROUND

Technical Field

The present disclosure relates to a method for manufacturing a fin.

Background Art

Japanese Patent No. 2695126 discloses a mold apparatus for manufacturing a fin. The mold apparatus described in Japanese Patent No. 2695126 manufactures the fin by pressing a thin metal plate. When the fin is manufactured, pressure is applied to the thin metal plate by press working. However, the pressure is applied unevenly to part of the thin metal plate, and the fin may be warped.

SUMMARY

A first aspect is directed to a method for manufacturing a fin. The method for manufacturing the fin is a method for processing a plate-shaped fin material into a fin for a heat exchanger. The method for manufacturing a fin for a heat exchanger includes a waffle forming step of forming a waffle portion and a plate-shaped portion around the waffle portion in a plate-shaped fin material, a cutting step of forming a continuous portion continuous with the plate-shaped portion and a fin slit configured to receive a flat tube in a side of the plate-shaped portion of the plate-shaped fin material, and a drawing step of forming a drawn portion protruding with respect to the continuous portion in the continuous portion.

DETAILED DESCRIPTION OF EMBODIMENT(S)

Embodiments of the present disclosure will be described in detail below with reference to the drawings. The present disclosure is not limited to the embodiments shown below, and various changes can be made within the scope without departing from the technical concept of the present disclosure. Each of the drawings is intended to illustrate the present disclosure conceptually, and dimensions, ratios, or numbers may be exaggerated or simplified as necessary for the sake of ease of understanding.

An exemplary embodiment will be described in detail below with reference to the drawings.

Configuration of Fin

Figure 1:
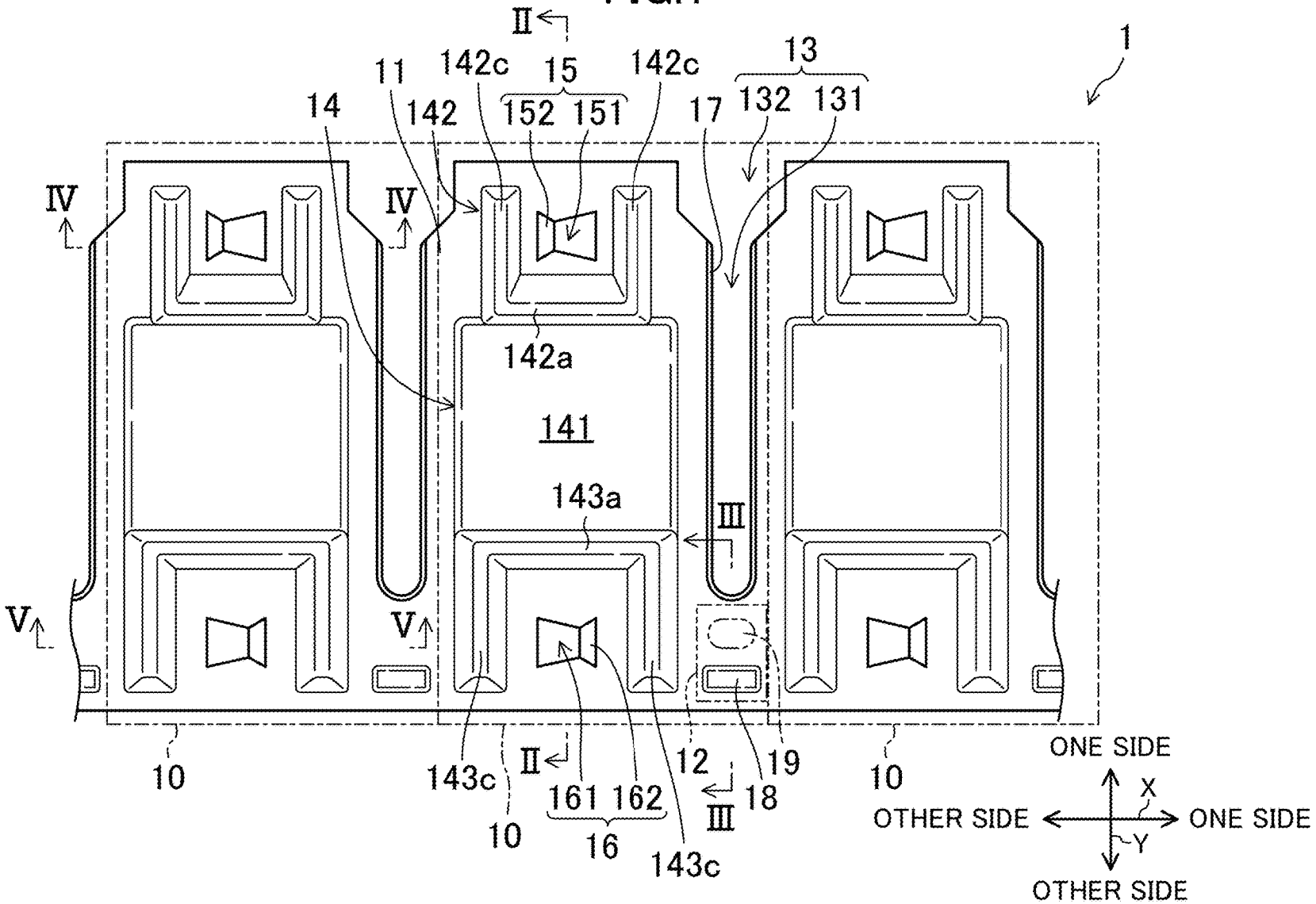
FIG. 1 is a plan view of a fin according to an embodiment.
Figure 2:
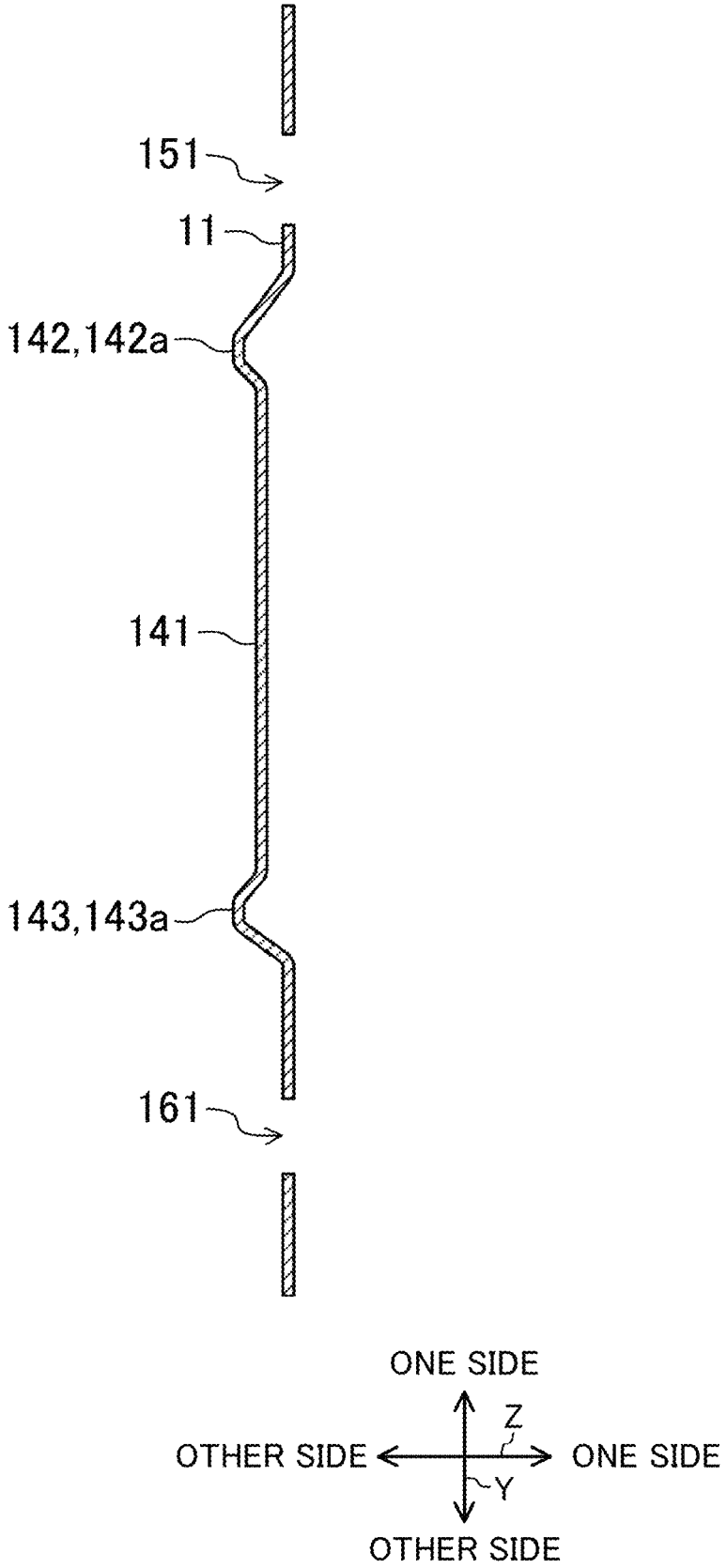
FIG. 2 is a sectional end view of the fin shown in FIG. 1 taken along line II-II.
Figure 3:
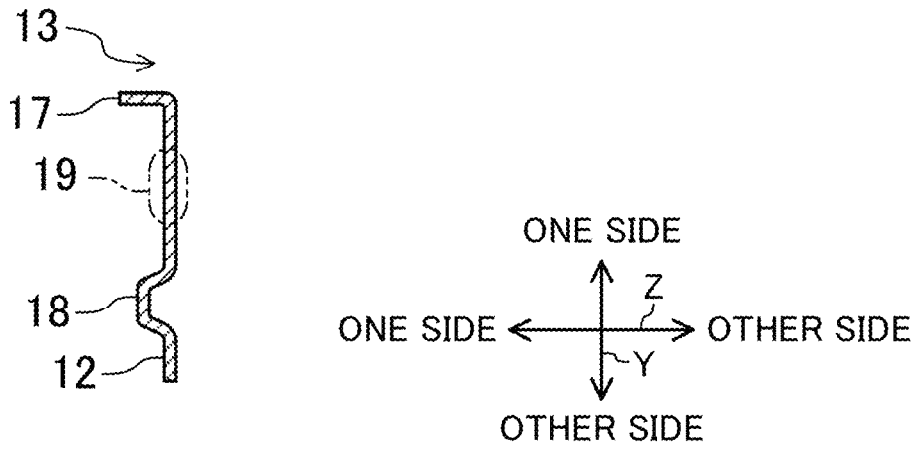
FIG. 3 is a sectional end view of the fin shown in FIG. 1 taken along line III-III.
Figure 4:
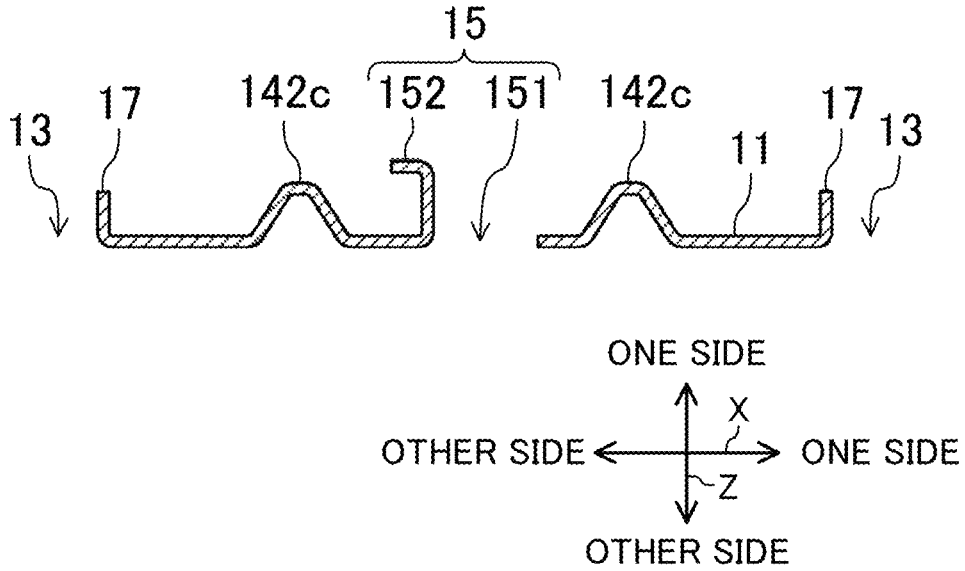
FIG. 4 is a sectional end view of the fin shown in FIG. 1 taken along line IV-IV.
Figure 5:
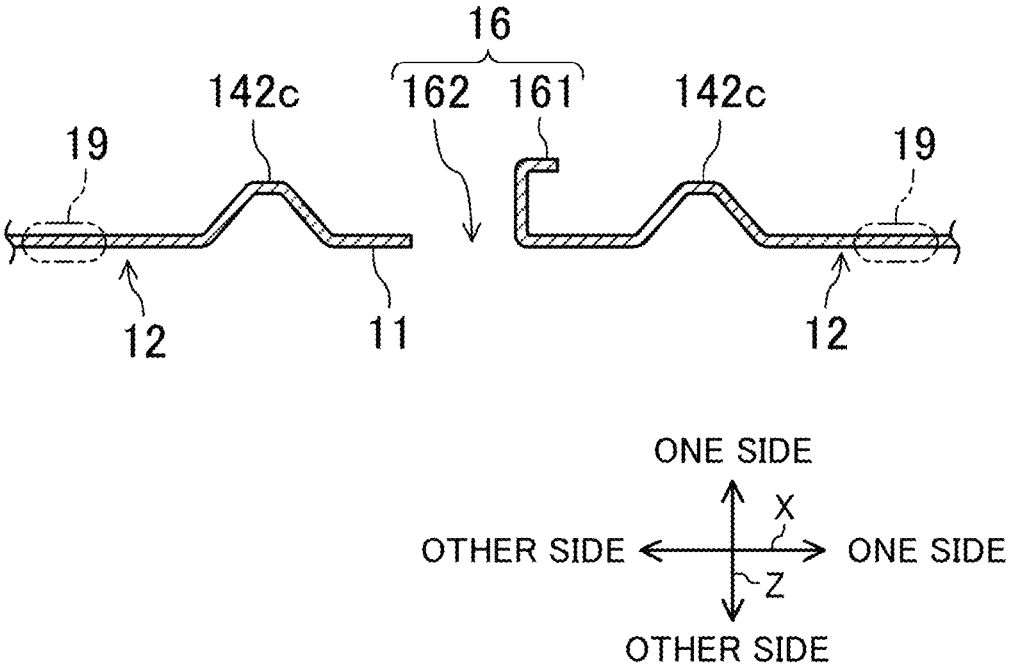
FIG. 5 is a sectional end view of the fin shown in FIG. 1 taken along line V-V.

FIG. 1 is a plan view of a fin (1) for a heat exchanger. FIG. 2 is a sectional end view taken along line II-II shown in FIG. 1. FIG. 3 is a sectional end view taken along line III-III shown in FIG. 1. FIG. 4 is a sectional end view taken along line IV-IV shown in FIG. 1. FIG. 5 is a sectional end view taken along line V-V shown in FIG. 1. In FIGS. 1 to 5, an X-axis direction, a Y-axis direction, and a Z-axis direction are directions perpendicular to each other. The heat exchanger is provided in, for example, an indoor unit or outdoor unit of an air conditioner. The heat exchanger is a device that condenses or evaporates a refrigerant using air as a cooling source or a heating source, and is, for example, a component of a refrigerant circuit of a vapor compression refrigeration apparatus. Examples of the refrigerant circulating through the refrigerant circuit include a carbon dioxide refrigerant.

As illustrated in FIGS. 1 to 5, the fin (1) includes a plurality of structural units (10). The structural units (10) are continuously arranged side by side in the X-axis direction. Each of the structural units (10) includes a plate-shaped portion (11), a continuous portion (12), a fin slit (13), a waffle portion (14), a first fin tab (15), a second fin tab (16), a flange (17), a drawn portion (18), and a dent.

The plate-shaped portion (11) is a plate-shaped member having a thickness in the Z-axis direction. The plate-shaped portions (11) are arranged side by side in the X-axis direction. The continuous portion (12) is provided between an adjacent pair of plate-shaped portions (11).

The continuous portion (12) is a plate-shaped member having a thickness in the Z-axis direction and surfaces that are perpendicular to the Z-axis direction on one side and the other side in the Z-axis direction. The continuous portion (12) is provided to be continuous with each of the adjacent plate-shaped portions (11). Each of the surfaces of the continuous portion (12) on the one side and the other side in the Z-axis direction is flush with the adjacent plate-shaped portions (11). In the Y-axis direction, the continuous portion (12) has a smaller dimension than the plate-shaped portion (11). The continuous portion (12) is located between the plate-shaped portions (11) adjacent to each other. The continuous portion (12) is located on the other side of the fin (1) in the Y-axis direction.

The fin slit (13) is a space formed between the adjacent plate-shaped portions (11) and the continuous portion (12). The fin slit (13) extends in the Y-axis direction. In the Y-axis direction, the fin slit (13) has a smaller dimension than the plate-shaped portion (11). The fin slit (13) is provided between the adjacent plate-shaped portions (11) on one side of the continuous portion (12) in the Y-axis direction. For the fin slit (13), one side and the other side in the X-axis direction are blocked by the plate-shaped portions (11), an opening is formed on one side in the Y-axis direction to open the one side, the other side in the Y-axis direction is blocked by the continuous portion (12), and one side and the other side in the Z-axis direction are open. The fin slit (13) includes a first slit portion (131) and a second slit portion (132). The first slit portion (131) is a portion of the fin slit (13) located on one side in the Y-axis direction. The second slit portion (132) is a portion of the fin slit (13) located on the other side in the Y-axis direction. The second slit portion (132) is continuous with the first slit portion (131) and extends from the first slit portion (131) toward the other side in the Y-axis direction.

A flat tube for sending a refrigerant is inserted into the fin slit (13). The dimension of the second slit portion (132) in the X-axis direction is set to match the dimension of the flat tube so that the flat tube can fit into the slit. The first slit portion (131) is configured to have a larger dimension than the second slit portion (132) in the X-axis direction so that the first slit portion (131) functions as a guide slit that guides the flat tube entering the fin slit (13). This allows easy insertion of the flat tube into the fin slit (13).

The waffle portion (14) is provided on the plate-shaped portion (11), and is shaped to protrude from the plate-shaped portion (11) toward the one side in the Z-axis direction. The waffle portion (14) includes a center portion (141) located at the center of the plate-shaped portion (11) in the Y-axis direction, a first rib (142) formed on one side of the center portion (141) in the Y-axis direction, and a second rib (143) formed on the other side of the center portion (141) in the Y-axis direction. The center portion (141) is formed in a substantially rectangular shape, for example. The first rib (142) protrudes more toward the one side in the Z-axis direction than the center portion (141). The first rib (142) includes a first bridge portion (142*a*) and a pair of first extensions (142*c*). The first bridge portion (142*a*) is provided at an edge of the center portion (141) on the one side in the Y-axis direction, and extends in the X-axis direction. One of the pair of first extensions (142*c*) extends from an end of the first bridge portion (142*a*) on the one side in the X-axis direction to the one side in the Y-axis direction. The other of the pair of first extensions (142*c*) extends from an end of the first bridge portion (142*a*) on the other side in the X-axis direction to the one side in the Y-axis direction. The second rib (143) protrudes more toward the one side in the Z-axis direction than the center portion (141). The second rib (143) includes a second bridge portion (143*a*) and a pair of second extensions (143*c*). The second bridge portion (143*a*) is provided at an edge of the center portion (141) on the other side in the Y-axis direction, and extends in the X-axis direction. One of the second extensions (143*c*) in pair extends from an end of the second bridge portion (143*a*) on the one side in the X-axis direction to the other side in the Y-axis direction. The other of the second extensions (143*c*) in pair extends from an end of the second bridge portion (143*a*) on the other side in the X-axis direction to the other side in the Y-axis direction.

The first fin tab (15) is provided in the plate-shaped portion (11) between the first extensions (142*c*) in pair. The first fin tab (15) includes a first through hole (151) and a first protrusion (152). The first through hole (151) is a hole penetrating the plate-shaped portion (11) in the Z-axis direction. The first through hole (151) is, for example, substantially rectangular. The first protrusion (152) is provided at an edge of the first through hole (151) on the other side in the X-axis direction, and is shaped to protrude from the plate-shaped portion (11) toward the one side in the Z-axis direction.

The second fin tab (16) is provided in the plate-shaped portion (11) between the second extensions (143*c*) in pair. The second fin tab (16) includes a second through hole (161) and a second protrusion (162). The second through hole (161) is a hole penetrating the plate-shaped portion (11) in the Z-axis direction. The second through hole (161) is, for example, substantially rectangular. The second protrusion (162) is provided at an edge of the second through hole (161) on the one side in the X-axis direction, and is shaped to protrude from the plate-shaped portion (11) toward the one side in the Z-axis direction.

The flange (17) has a shape obtained by bending part of the plate-shaped portion (11) at the edge of the fin slit (13) toward the one side in the Z-axis direction. The flange (17) is formed along an edge of the second slit portion (132) of the fin slit (13). The flange (17) has a substantially U-shape. The flange (17) maintains the strength of the fin (1), protecting the fin (1) from deformation when the flat tube is inserted into the fin slit (13). The flat tube inserted into the fin slit (13) can effectively make contact with the flange (17). This allows the flat tube to be effectively fixed to the fin (1) by, for example, brazing.

The drawn portion (18) is provided in the continuous portion (12), and is shaped to protrude from the continuous portion (12) toward the one side in the Z-axis direction. The dent is provided in the continuous portion (12). The dent indicates a hit part of the continuous portion (12). In the continuous portion (12), the dent is in a location different from the drawn portion (18). The dent is provided, for example, in an area (19) of the continuous portion (12) located on the one side of the drawn portion (18) in the Y-axis direction.

Apparatus for Manufacturing Fin

Figure 6:
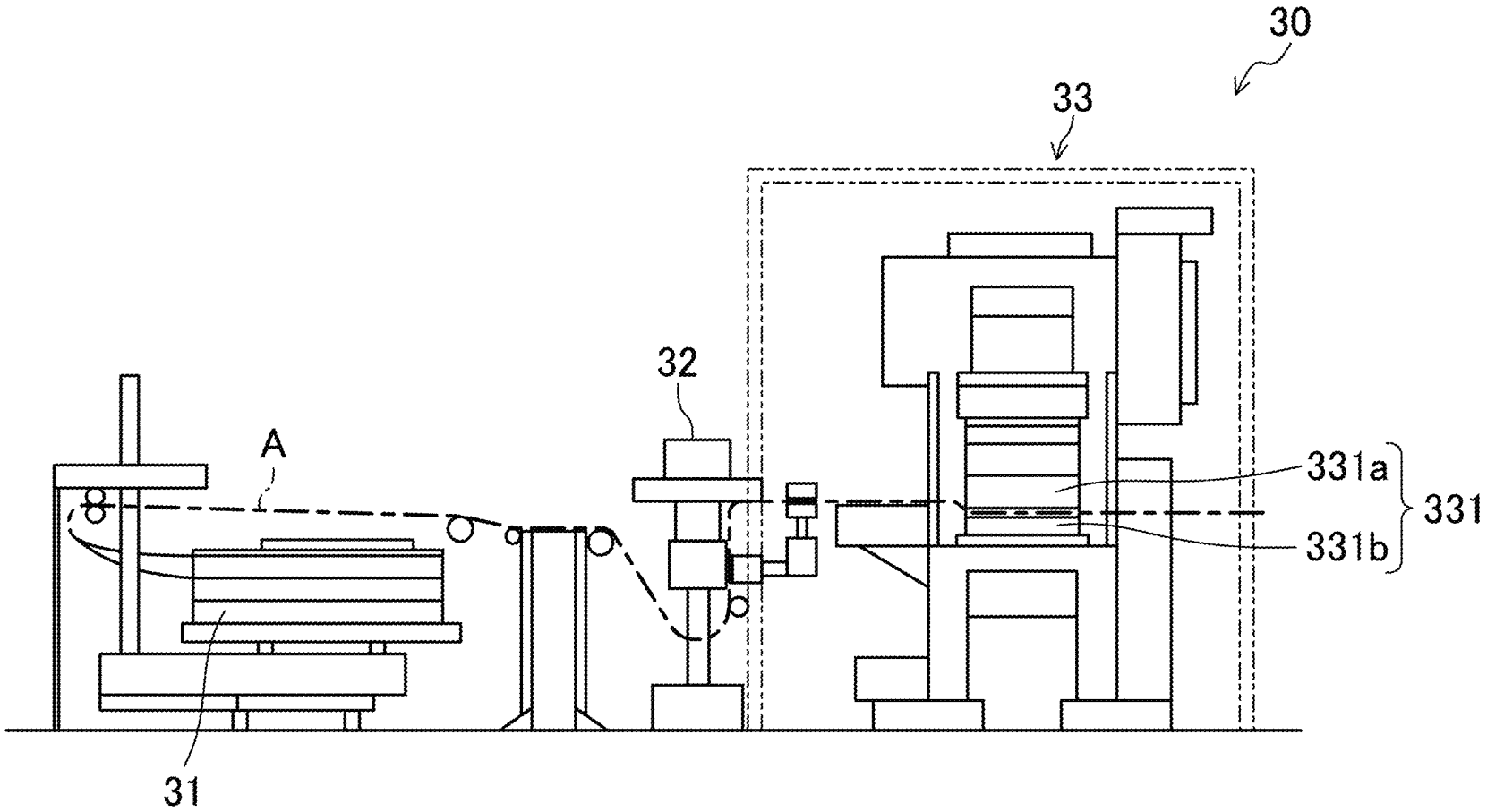
FIG. 6 is a view of an apparatus for manufacturing the fin.

FIG. 6 is a schematic view of a manufacturing apparatus (30) for the fin (1). The manufacturing apparatus (30) for the fin (1) will be described with reference to FIG. 6.

As illustrated in FIG. 6, the manufacturing apparatus (30) for the fin (1) includes an uncoiler (31), a feeder (32), and a press (33). A plate-shaped fin material (A) is wound around the uncoiler (31). The fin material (A) is, for example, a member made of metal such as aluminum. The feeder (32) feeds the fin material (A) wound around the uncoiler (31) to the press (33). The feeder (32) includes, for example, a gripper feeder having a fixed clamp and a movable clamp. The feeder (32) feeds the fin material (A) to the press (33) by alternately repeating, for example, an action of moving the movable clamp holding the fin material (A) while the fixed clamp is releasing the fin material (A) and an action of returning the movable clamp releasing the fin material (A) to the former position while the fixed clamp is holding the fin material (A). The press (33) includes a die (331). The die (331) includes an upper die (331*a*) which can move up and down and a stationary lower die (331*b*). The lower die (331*b*) is disposed below the upper die (331*a*). The upper die (331*a*) and the lower die (331*b*) are suitably provided with punches and dies for forming the fin slit (13), the waffle portion (14), the first fin tab (15), the second fin tab (16), the flange (17), the drawn portion (18), and the dent. When the upper die (331*a*) moves downward with the fin material (A) disposed on the lower die (331*b*), the fin material (A) is sandwiched between the upper die (331*a*) and the lower die (331*b*) and pressed by the die (331). As a result, components of the fin (1) such as the fin slit (13) and the waffle portion (14) are formed in the fin material (A) (see FIGS. 1 to 5).

Method for Manufacturing Fin

Figure 7:
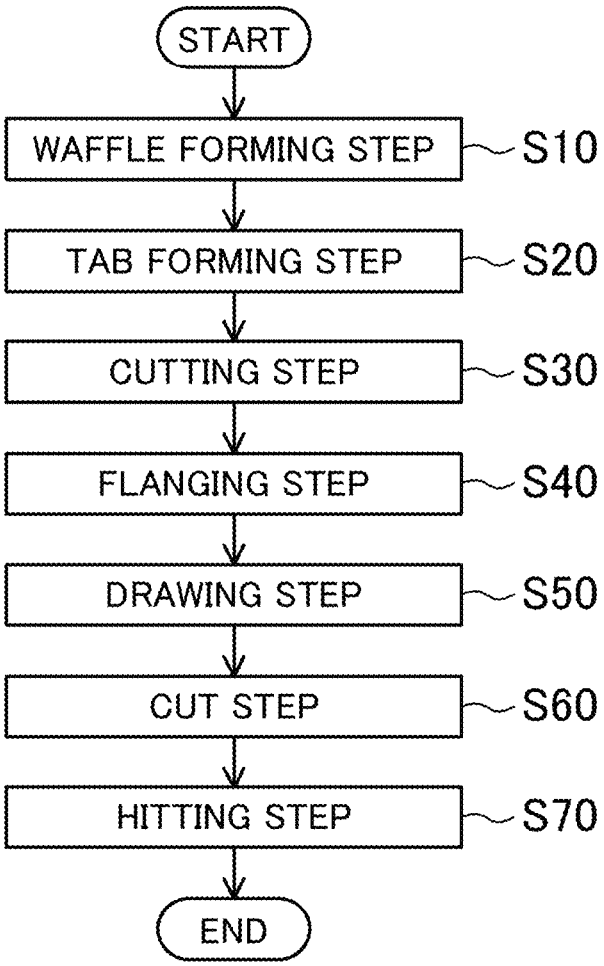
FIG. 7 is a flowchart of a method for manufacturing the fin.
Figure 8A:
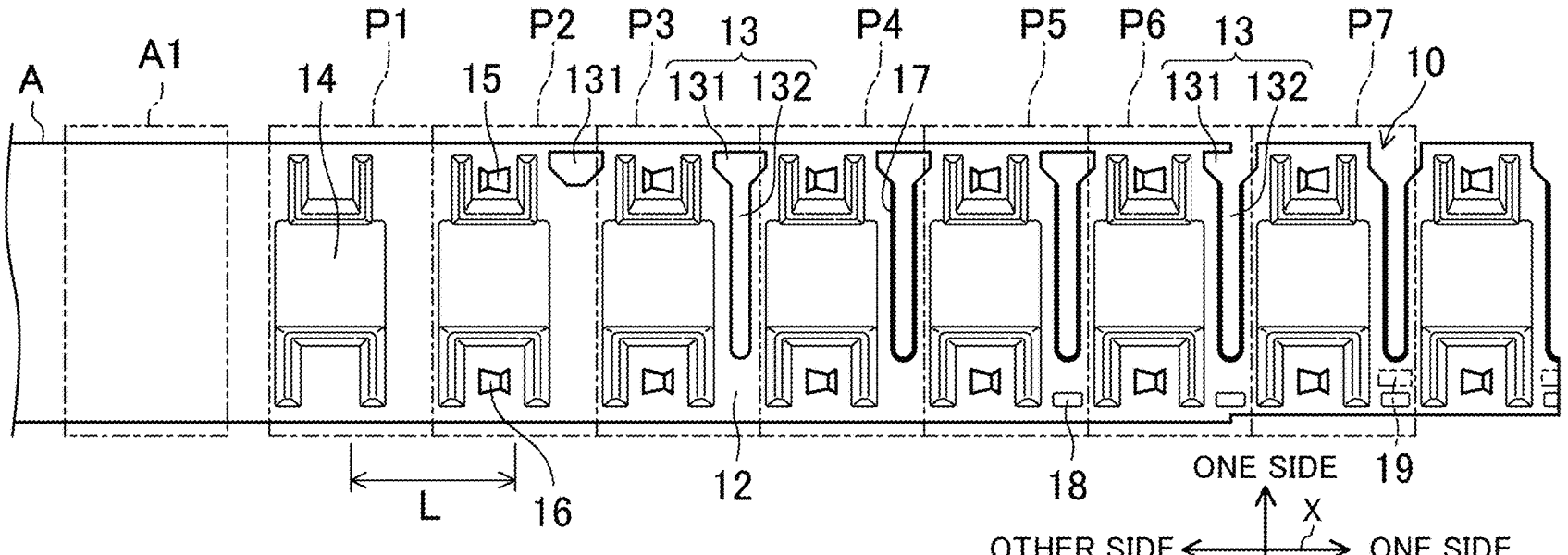
FIG. 8A is a plan view of a process of manufacturing the fin.
Figure 8B:
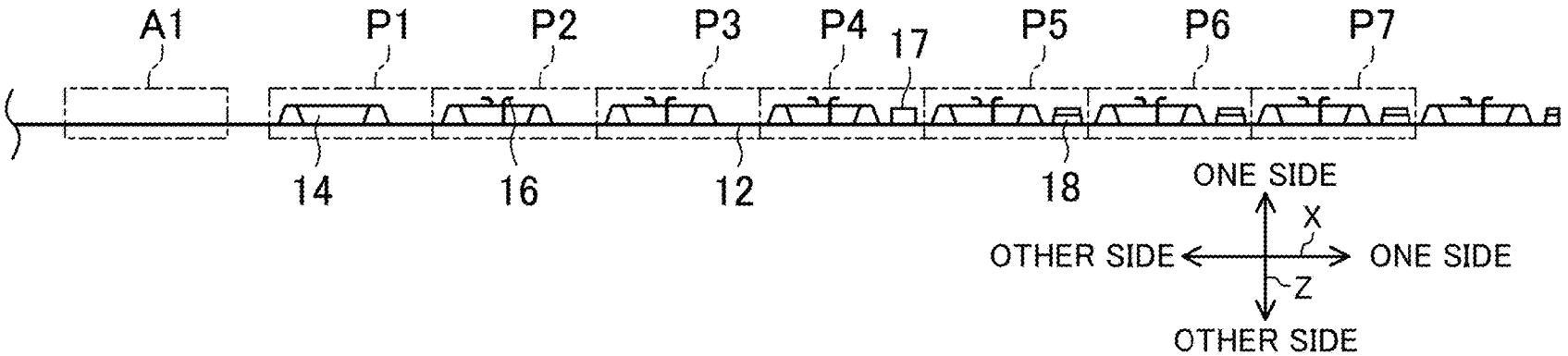
FIG. 8B is a front view of the process of manufacturing the fin.

FIG. 7 is a flowchart of a method for manufacturing the fin (1). FIGS. 8A and 8B are schematic views of a process of manufacturing the fin (1) by pressing using the die (331). The method for manufacturing the fin (1) will be described with reference to FIGS. 6 to 8B. In this embodiment, the feeder (32) feeds the fin (1) to the one side in the X-axis direction.

As illustrated in FIGS. 6, 8A, and 8B, seven points from a first point (P1) to a seventh point (P7) are set between the upper die (331*a*) and lower die (331*b*) of the die (331). The first point (P1) to the seventh point (P7) are located in the order of the first point (P1), the second point (P2), the third point (P3), the fourth point (P4), the fifth point (P5), the sixth point (P6), and the seventh point (P7) in the feeding direction of the fin (1) (toward the one side in the X-axis direction).

The following description will be made focusing on a specific portion (A1) of the fin material (A). While the fin material (A) is being fed, the specific portion (A1) of the fin material (A) passes the first to seventh points (P1) to (P7) in the order of the first point (P1), the second point (P2), the third point (P3), the fourth point (P4), the fifth point (P5), the sixth point (P6), and the seventh point (P7).

As illustrated in FIGS. 6 to 8B, the specific portion (A1) of the fin material (A) that has reached the first point (P1) is pressed by the die (331) in Step S10. This pressing forms the waffle portion (14) in the specific portion (A1) (a waffle forming step).

In Step S20, the specific portion (A1) of the fin material (A) that has reached the second point (P2) is pressed by the die (331). This pressing forms the first fin tab (15), the second fin tab (16), and the first slit portion (131) of the fin slit (13) in the specific portion (A1) (a tab forming step).

In Step S30, the specific portion (A1) of the fin material (A) that has reached the third point (P3) is pressed by the die (331). This pressing forms the continuous portion (12) and the second slit portion (132) of the fin slit (13) in the specific portion (A1) (a cutting step).

In Step S40, the specific portion (A1) of the fin material (A) that has reached the fourth point (P4) is pressed by the die (331). This pressing forms the flange (17) in the specific portion (A1) (a flanging step).

In Step S50, the specific portion (A1) of the fin material (A) that has reached the fifth point (P5) is pressed by the die (331). This pressing forms the drawn portion (18) in the specific portion (A1) (a drawing step).

In Step S60, the specific portion (A1) of the fin material (A) that has reached the sixth point (P6) is pressed by the die (331). This pressing cuts an unwanted part of the specific portion (A1) so that the fin slit (13) communicates with external space (cut step).

In Step S70, the specific portion (A1) of the fin material (A) that has reached the seventh point (P7) is pressed by the die (331). This pressing hits the continuous portion (12) of the specific portion (A1), thereby forming a dent in the continuous portion (12) (hitting step). In this embodiment, the dent is formed in the area (19) of the continuous portion (12). In the hitting step of this embodiment, the continuous portion (12) is hit from the side toward which the drawn portion (18) protrudes. As a result, the structural unit (10) of the fin (1) (see FIG. 1) is formed in the specific portion (A1) of the fin material (A).

Each of the first to seventh points (P1) to (P7) is spaced apart from the adjacent point in the feeding direction by a distance L. Each time the fin material (A) is fed by the distance L in the feeding direction (to the one side in the X-axis direction), the fin material (A) is pressed by the die (331). Thus, processes of Steps S10 to S70 described above are performed on the entire fin material (A). As a result, multiple structural units (10) are formed to be arranged side by side in the X-axis direction as illustrated in FIG. 1, and thus, the fin (1) is manufactured.

Advantages

Figure 9A:
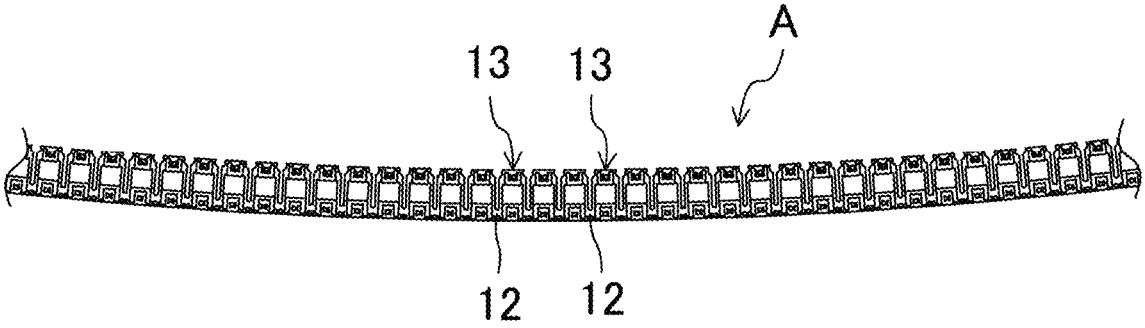
FIG. 9A is a view of a warped fin material.
Figure 9B:
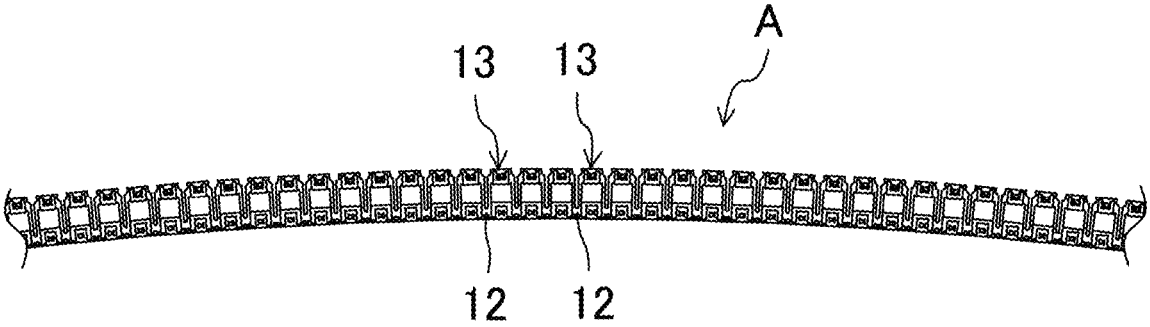
FIG. 9B is a view of a warped fin material.

As described above, the drawn portion (18) protruding with respect to the continuous portion (12) is formed in the continuous portion (12) in the drawing step. Thus, although the fin material (A) is warped to be convex toward the continuous portion (12) (see FIG. 9A) as a result of the formation of the fin slit (13) and other components in the fin material (A), the warp toward the continuous portion (12) can be corrected by the drawn portion (18) formed in the continuous portion (12), thereby reducing the warp of the fin (1). If the continuous portion (12) is excessively drawn by the formation of the drawn portion (18), the fin material (A) is warped to be convex toward the fin slit (13). Thus, for the fin (1) with less warp as illustrated in FIG. 1, the dimension and depth of the drawn portion (18) are controlled so that the continuous portion (12) is not excessively drawn by the formation of the drawn portion (18).

The continuous portion (12) can be stretched by hitting the continuous portion (12) in the hitting step. This can correct the length of the fin (1) so that the fin (1) is not excessively shorter than a predetermined target length.

While the embodiments and the variations thereof have been described above, it will be understood that various changes in form and details may be made without departing from the spirit and scope of the claims (e.g., (1) below). The embodiments, the variation thereof, and the other embodiments may be combined and replaced with each other without deteriorating intended functions of the present disclosure.

(1) In the method for manufacturing the fin (1), a plurality of fins (1) may be formed on a single fin material (A). In this case, the fins (1) are formed in parallel on the single fin material (A), and a cut step of cutting a portion between the adjacent fins (1) is added. Further, the hitting step is performed after the cut step, thereby correcting the length of each of the fins (1).

As can be seen from the foregoing description, the present disclosure is useful for a method for manufacturing a fin.

The invention claimed is:

1. A method for manufacturing a fin by processing a plate-shaped fin material into a fin for a heat exchanger, the method comprising:

a waffle forming step of forming a waffle portion and a plate-shaped portion around the waffle portion in the plate-shaped fin material;

a cutting step of forming a continuous portion continuous with the plate-shaped portion, and a fin slit configured to receive a flat tube in a side of the plate-shaped portion of the plate-shaped fin material;

a drawing step of forming a drawn portion protruding with respect to the continuous portion in the continuous portion; and a hitting step of hitting the continuous portion, the waffle forming step, the cutting step, the drawing step, and the hitting step being performed by pressing the plate-shaped fin material using a die including an upper die and a lower die.

2. The method of claim 1, wherein in the hitting step, the continuous portion is hit from a side toward which the drawn portion protrudes.

3. The method of claim 1, further comprising:

a flanging step of forming a flange at an edge of the fin slit.

4. The method of claim 1, further comprising:

a step of forming a plurality of the fins on the plate-shaped fin material; and a cut step of cutting a portion between the fins adjacent to each other, the hitting step being performed after the cut step is finished.

5. The method of claim 1, wherein the waffle forming step, the cutting step, the drawing step, and the hitting step are performed, respectively, at a plurality of positions set between the upper die and the lower die, and the fin material is fed such that a specific portion of the fin material passes each of the plurality of positions, and each time the specific portion reaches any one of the plurality of positions, the specific portion is pressed between the upper die and the lower die to perform the respective one of the waffle forming step, the cutting step, the drawing step, and the hitting step.

6. The method of claim 1, wherein the plate-shaped portion includes a plurality of plate-shaped portions arranged side by side, the continuous portion is located between adjacent ones of the plurality of plate-shaped portions, and the drawn portion is formed within an area of the continuous portion.

* * * * *